US005156128A

United States Patent [19]

Nakagawa

[11] Patent Number: 5,156,128

[45] Date of Patent: Oct. 20, 1992

[54] APPARATUS FOR CONTROLLING VARIATION IN TORQUE OF INTERNAL COMBUSTION ENGINE

[75] Inventor: Norihisa Nakagawa, Numazu, Japan

[73] Assignee: Toyota Jidosha Kabushiki Kaisha, Toyota, Japan

[21] Appl. No.: 804,945

[22] Filed: Dec. 11, 1991

[30] Foreign Application Priority Data

Dec. 14, 1990 [JP] Japan ..... 2-402462

[51] Int. Cl.[5] ..... F02M 7/00; F02P 5/06

[52] U.S. Cl. ..... 123/436; 123/419

[58] Field of Search ..... 123/436, 419, 428; 364/431.08

[56] References Cited

U.S. PATENT DOCUMENTS

| | | | |
|---|---|---|---|
| 4,380,800 | 4/1983 | Wilkenson | 123/436 |
| 4,461,257 | 7/1984 | Hosaka et al. | 123/419 |
| 4,475,511 | 10/1984 | Johnson et al. | 123/436 |
| 4,513,721 | 4/1985 | Ina et al. | 123/478 |
| 4,552,113 | 11/1985 | Williams | 123/436 |
| 4,635,601 | 1/1987 | Cornelius | 123/436 |
| 4,751,906 | 6/1988 | Yatabe et al. | 123/436 |
| 4,776,312 | 10/1988 | Yoshioka et al. | 123/436 |

FOREIGN PATENT DOCUMENTS

| | | | |
|---|---|---|---|
| 2-67444 | 3/1990 | Japan | 123/436 |
| 2-75742 | 3/1990 | Japan | 123/436 |
| 2-176132 | 7/1990 | Japan | 123/436 |

*Primary Examiner*—Raymond A. Nelli
*Attorney, Agent, or Firm*—Kenyon & Kenyon

[57] ABSTRACT

An apparatus for controlling a torque generated by an internal combustion engine includes a measurement unit for periodically measuring a torque variation amount of the internal combustion engine, a detection unit for detecting an engine operating condition and a predetermined change therein, and a storage unit for storing target torque variation amounts respectively related to predetermined engine operating conditions. A control unit controls a predetermined engine control parameter of the internal combustion engine so that the torque variation amount is approximately equal to one of the target torque variation amounts related to one of the predetermined engine operating conditions which corresponds to the engine operating condition detected by the detection unit. An updating unit generates, when the detection unit detects the predetermined change in the engine operating condition, an update torque variation amount from at least one of the target torque variation amounts which is read out from the storage unit on the basis of a new engine operating condition obtained after the predetermined change in the engine operating condition and outputs the updated torque variation amount to the control unit.

18 Claims, 8 Drawing Sheets

| | | | | | |
|---|---|---|---|---|---|
| Q | $K_{30}$ | $K_{31}$ | $K_{32}$ | $K_{33}$ | $K_{34}$ |
| N | $K_{20}$ | $K_{21}$ | $K_{22}$ | $K_{23}$ | $K_{24}$ |
| S | $K_{10}$ | $K_{11}$ | $K_{12}$ | $K_{13}$ | $K_{14}$ |
| M | $K_{00}$ | $K_{01}$ | $K_{02}$ | $K_{03}$ | $K_{04}$ |

800 NE 3200 (rpm)

APPARATUS FOR CONTROLLING VARIATION IN TORQUE OF INTERNAL COMBUSTION ENGINE

BACKGROUND OF THE INVENTION

1. Field of the Invention

The present invention generally relates to an apparatus for controlling a variation in torque of an internal combustion engine, and more particularly to a torque variation control apparatus which controls a predetermined parameter of the internal combustion engine so that the amount of intercycle variation in torque of the internal combustion engine is maintained within an allowable torque variation amount range.

2. Description of the Related Art

As is well known, various apparatuses have been proposed which intend to improve the fuel economy of an internal combustion engine and reduce the amount of nitrogen oxides (NOx) therein. Japanese Laid-Open Patent Publication No. 2-176138, for example, discloses an apparatus which measures the amount of intercycle variation in torque of the internal combustion engine and controls a predetermined engine control parameter so that the measured intercycle torque variation amount becomes equal to a target torque variation amount suitable for a current engine operating condition. Some features of conventional methods are, for example, that the air-fuel ratio is controlled so that a mixture of air and fuel is as lean as possible, or that an exhaust gas recirculation system is controlled so that an increased amount of exhaust gas is fed back to an intake manifold.

However, the conventional torque variation control apparatus disclosed in the above Japanese publication has the following disadvantage. If the engine operating condition changes during a procedure for generating a torque variation amount which is based on an average (or weighted average) of intercycle torque variation amounts obtained by sampling for a predetermined number of cycles of the engine and which is to be compared with the target torque variation amount, all the torque variation amounts obtained before the engine operating condition changes are reset to zeros. After all the torque variation amounts are reset, the torque variation amount cannot be obtained until the interchange torque variations amounts for the predetermined number of cycles in the changed (new) engine operating condition are obtained. Hence, it is impossible to accurately control the torque variation until the predetermined number of cycles elapse.

SUMMARY OF THE INVENTION

It is a general object of the present invention to provide a torque variation control apparatus in which the above disadvantages are eliminated.

A more specific object of the present invention is to provide a torque variation control apparatus capable of accurately and rapidly controlling the torque variation amount even immediately after the engine operating condition changes.

The above-mentioned objects of the present invention are achieved by an apparatus for controlling a torque generated by an internal combustion engine, the apparatus comprising: measurement means for periodically measuring a torque variation amount of the internal combustion engine; detection means for detecting an engine operating condition and a predetermined change therein; storage means for storing target torque variation amounts respectively related to predetermined engine operating conditions; control means, operatively coupled to the measurement means, the detection means and storage means, for controlling a predetermined engine control parameter of the internal combustion engine so that the torque variation amount is approximately equal to one of the target torque variation amounts related to one of the predetermined engine operating conditions which corresponds to the engine operating condition detected by the detection means; and updating means, operatively coupled to the storage means, the detection means and the control means, for generating, when the detection means detects the predetermined change in the engine operating condition, an updated torque variation amount from at least one of the target torque variation amounts which is read out from the storage means on the basis of a new engine operating condition obtained after the predetermined change in the engine operating condition and for outputting the updated torque variation amount to the control means.

It is possible to use an allowable torque variation range which includes the above target torque variation amount.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
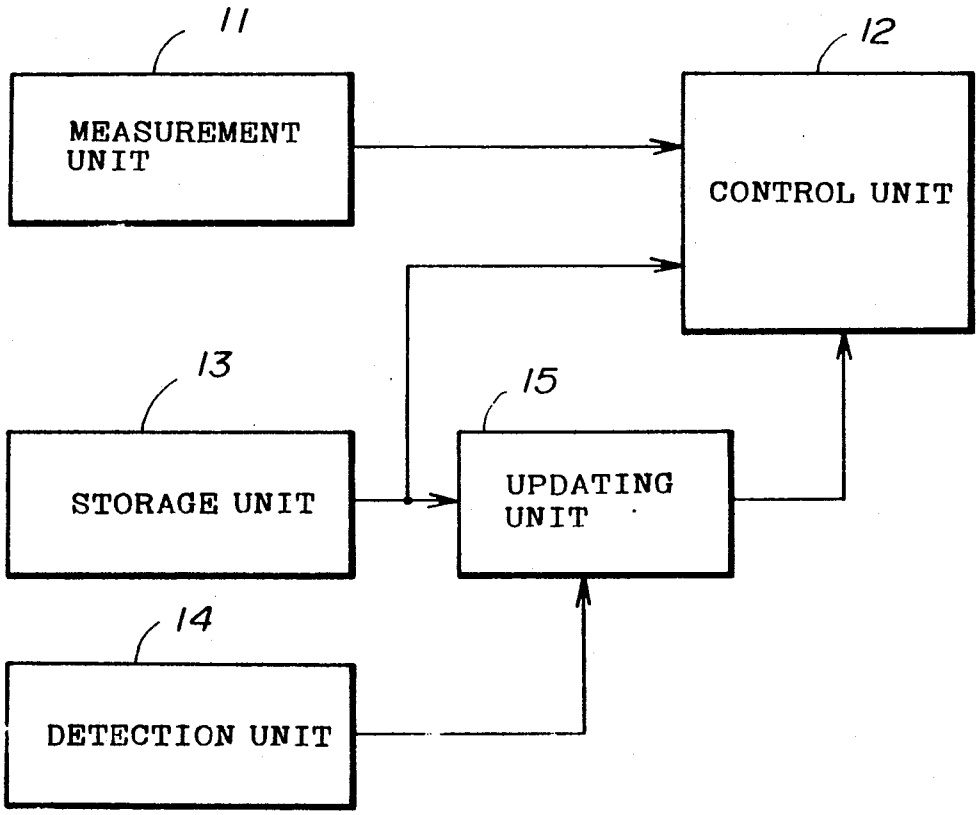
FIG. 1 is a block diagram of a torque variation control apparatus according to a preferred embodiment of the present invention.

FIG. 1 is a block diagram of a torque variation control apparatus according to a preferred embodiment of the present invention. The torque variation control apparatus shown in FIG. 1 is composed of a measurement unit 11, a control unit 12, a storage unit 13, a detection unit 14 and an updating unit 15.

The measurement unit 11 measures an intercycle variation amount of torque generated by an internal combustion engine. The intercycle variation amount of torque is the difference in torque between consecutive cycles of the engine. The control unit 12 controls a predetermined engine control parameter so that the torque variation amount generated from the intercycle torque variation amounts and measured by the measurement unit 11 is always within an allowable torque variation amount range, which is based on the engine operating condition. The storage unit 13 stores allowable torque variation amount ranges respectively defined for predetermined engine operating conditions. The detection unit 14 detects the engine operating condition and a predetermined change therein. When the detection unit 14 detects the predetermined change in the engine operating condition, the updating unit 15 generates an updated torque variation amount from at least one of the target torque variation amounts which is read out from the storage unit 13 on the basis of a new engine operating condition obtained after the predetermined change in the engine operating condition, and outputs the updated torque variation amount to the control unit 12. With this arrangement, it becomes possible to obtain the torque variation amount suitable for a new engine operating condition immediately after the engine changes to the new engine operating condition.

Figure 2:
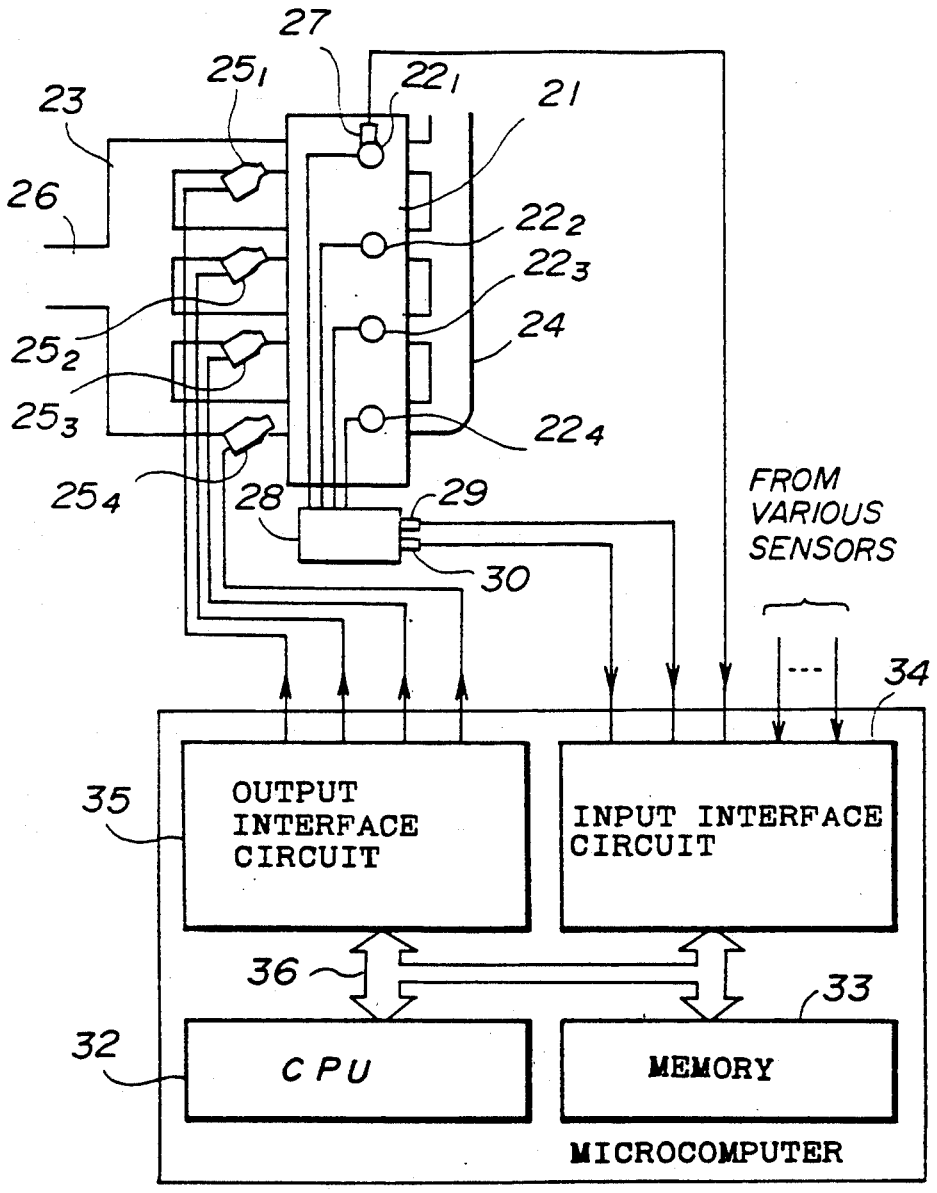
FIG. 2 is a block diagram of an outline of an internal combustion engine to which the present invention is applied.

FIG. 2 shows an outline of an internal combustion engine to which the present invention is applied. The internal combustion engine shown in FIG. 2 is a four-cylinder ignition type internal combustion engine, and has an engine main body 21 to which ignition plugs $\mathbf{22}_1$, $\mathbf{22}_2$, $\mathbf{22}_3$ and $\mathbf{22}_4$ are attached. Combustion chambers for the four respective cylinders are coupled to an intake manifold 23 having four branches and an exhaust manifold 24 having four branches.

Fuel injection valves $\mathbf{25}_1$, $\mathbf{25}_2$, $\mathbf{25}_3$ and $\mathbf{25}_4$ are respectively provided on the downstream sides of the four branches of the intake manifold 23. The upstream side of the intake manifold 23 is coupled to an intake passage 26. A combustion pressure sensor 27, which is fastened to the first cylinder (#1), directly measures pressure in the first cylinder. The combustion pressure sensor 27 is, for example, a heat-resistant piezoelectric type sensor, and generates an electric signal based on the pressure in the first cylinder.

A distributor 28 distributes a high voltage to the ignition plugs $\mathbf{22}_1$–$\mathbf{22}_4$. A reference position sensor 29 and a crank angle sensor 30 are fastened to the distributor 28. The reference position sensor 29 generates a reference position detection pulse signal every 720° crank angle, and the crank angle sensor 29 generates a crank angle detection signal every 30° crank angle.

A microcomputer 31 is composed of a CPU (Central Processing Unit) 32, a memory 33, an input interface circuit 34, and an output interface circuit 35, all of which are mutually coupled via a bidirectional bus 36. The microcomputer 31 forms the units 11, 12, 14 and 15 shown in FIG. 1, and the memory 33 corresponds to the storage unit 13 shown in FIG. 1.

Figure 3:
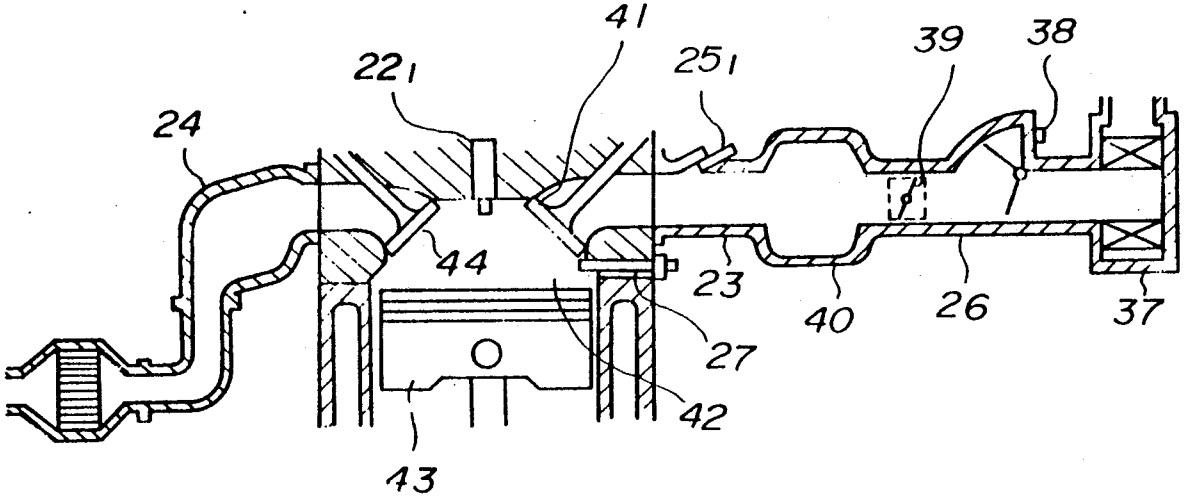
FIG. 3 is a cross-sectional view of a first cylinder of the internal combustion engine shown in FIG. 2 and a structure in the vicinity of the first cylinder.

FIG. 3 shows the first cylinder to which the combustion pressor sensor 27 is fastened and a structure in the vicinity of the first cylinder. In FIG. 3, those parts which are the same as those shown in FIG. 2 are given the same reference numerals. An airflow meter 38 measures the amount of air, which has been filtered by an air cleaner 37. Then, the air passes through a throttle valve 39 provided in the intake passage 26, and is then distributed to the branches of the intake manifold 23 by means of a surge tank 40. The air moving toward the first cylinder is mixed with fuel injected by the fuel injection valve $\mathbf{25}_1$, and sucked in a combustion chamber 42 when an intake value 41 is opened. A piston 43 is provided inside the combustion chamber 42, which is coupled to the exhaust manifold 24 via an exhaust valve 44. A leading end of the combustion pressure sensor 27 projects from the inner wall of the cylinder.

Figure 4A:
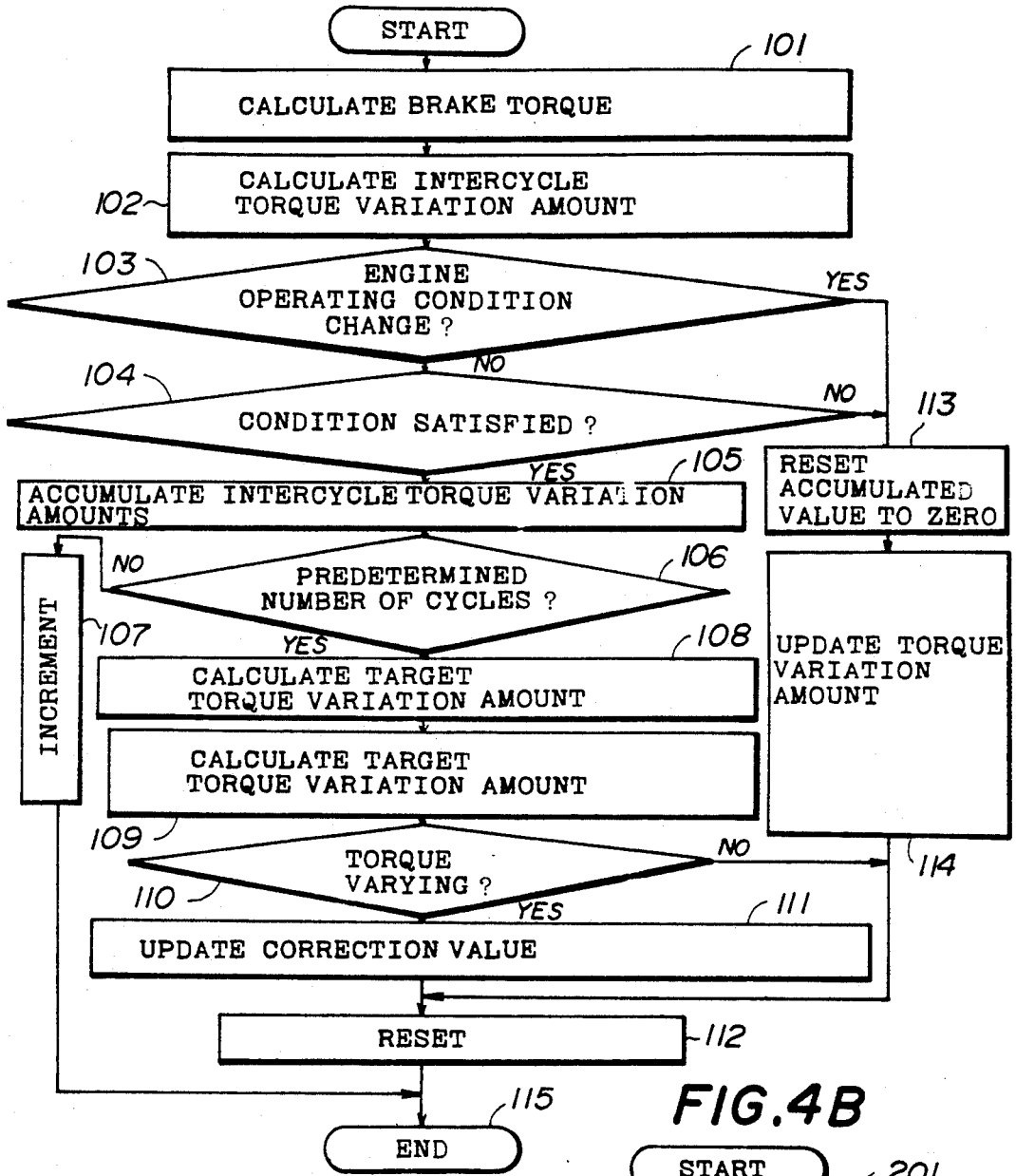
FIGS. 4A and 4B are respectively flowcharts of a torque variation control procedure according to the preferred embodiment of the present invention.
Figure 4B:
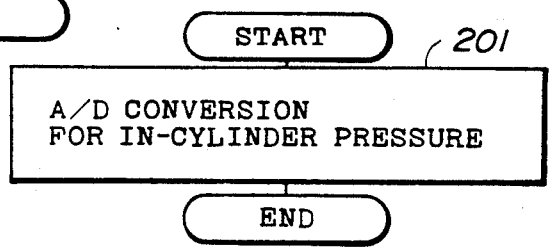

A description will now be given of a torque variation control procedure executed by the microcomputer 31 with reference to FIGS. 4A and 4B. FIG. 4A shows a main routine of the torque variation control procedure and which is activated every 720° of crank angle (CA). FIG. 4B is an in-cylinder pressure input routine, which is activated by an interruption which occurs every 30° of crank angle (CA). At step 201 of the interruption routine shown in FIG. 4B, an analog electric signal (combustion pressure signal) input to the interface circuit 34 from the combustion pressure sensor 27 is converted into a digital signal, which is stored in the memory 33. That is, the digital signal is stored in the memory 33 when the crank angle indicated by the crank angle detection signal is equal to BTDC (Before Top Dead Center) 155°, ATDC (After Top Dead Center) 5°, ATDC 20°, ATDC 35° or ATDC 50°.

Figure 5:
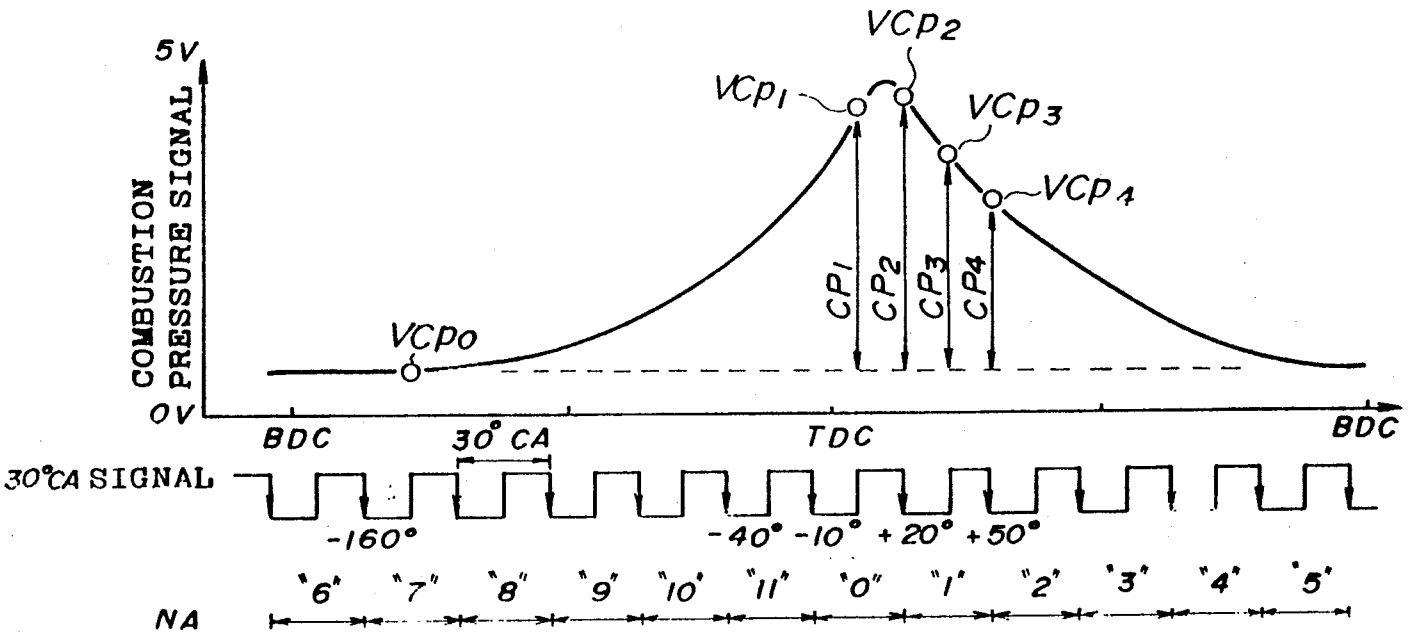
FIG. 5 is a diagram showing a relationship between a combustion pressure signal and a crank angle and a relationship between the combustion pressure signal and the counter value in an angle counter.

FIG. 5 is a diagram showing the relationship between the combustion pressure signal and the crank angle (CA) and the relationship between the combustion pressure signal and the counter value in an angle counter (NA). A combustion pressure signal VCP0 obtained with the crank angle equal to BTDC 155° is a reference level with respect to other crank angles in order to compensate for a drift of the combustion pressure signal due to a temperature change in the combustion pressure sensor 27 and a dispersion of the offset voltage.

In FIG. 5, VCP1, VCP2, VCP3 and VCP4 are respectively combustion pressure signals obtained when the crank angle is equal to ATDC 5°, ATDC 20°, ATDC 35° and ATDC 50°. NA denotes the counter value in the angle counter, which increases by 1 each time a 30° crank angle interruption is generated and is cleared every 360° crank angle. Since the ATDC 5° and ATDC 35° do not coincide with the 30° crank angle interruption positions. A timer (formed by software) is provided in which a time corresponding to a crank angle of 15° is set at the 30° interruption positions (NA="0", "1") immediately prior to ATDC 5° and ATDC 35°. The interruption request is given to the CPU 32 by means of the above timer.

At step 101 shown in FIG. 4A which is first executed each time the main routine is activated every 720° crank angle, the CPU 32 calculates the magnitude of a brake torque by using five pieces of combustion pressure data in the following manner. First, a combustion pressure CPn (n=1–4) with respect to VCP0 is calculated as follows:

$$Cpn = K1 \times (VCpn - VCp\mathbf{O}) \quad (1)$$

where K1 is a combustion-pressure-signal to combustion-pressure conversion coefficient. Next, the brake torque PTRQ for each of the cylinders is calculated as follows:

$$PTRQ = K2 \times (0.5\ CP1 + 2CP2 + 3CP3 + 4CP4) \quad (2)$$

where K2 is a combustion-pressure to torque conversion coefficient.

At step 102, the CPU 32 calculates intercycle torque variation amount DTRQ during a predetermined cycle for each of the cylinders as follows:

$$DTRQ = PTRQ_{i-1} - PTRQ_i \quad (3)$$

$$(DTRQ \geqq 0)$$

where $PTRQ_{i-1}$ is the previous brake torque, and $PTRQ_i$ is the present brake torque. It is recognized that torque variation occurs only when the intercycle torque variation amount DTRQ has a positive value, in other words, when the torque decreases. This is because it can be recognized that the torque changes along an ideal torque curve change when DTRQ has a negative value.

Figure 6:
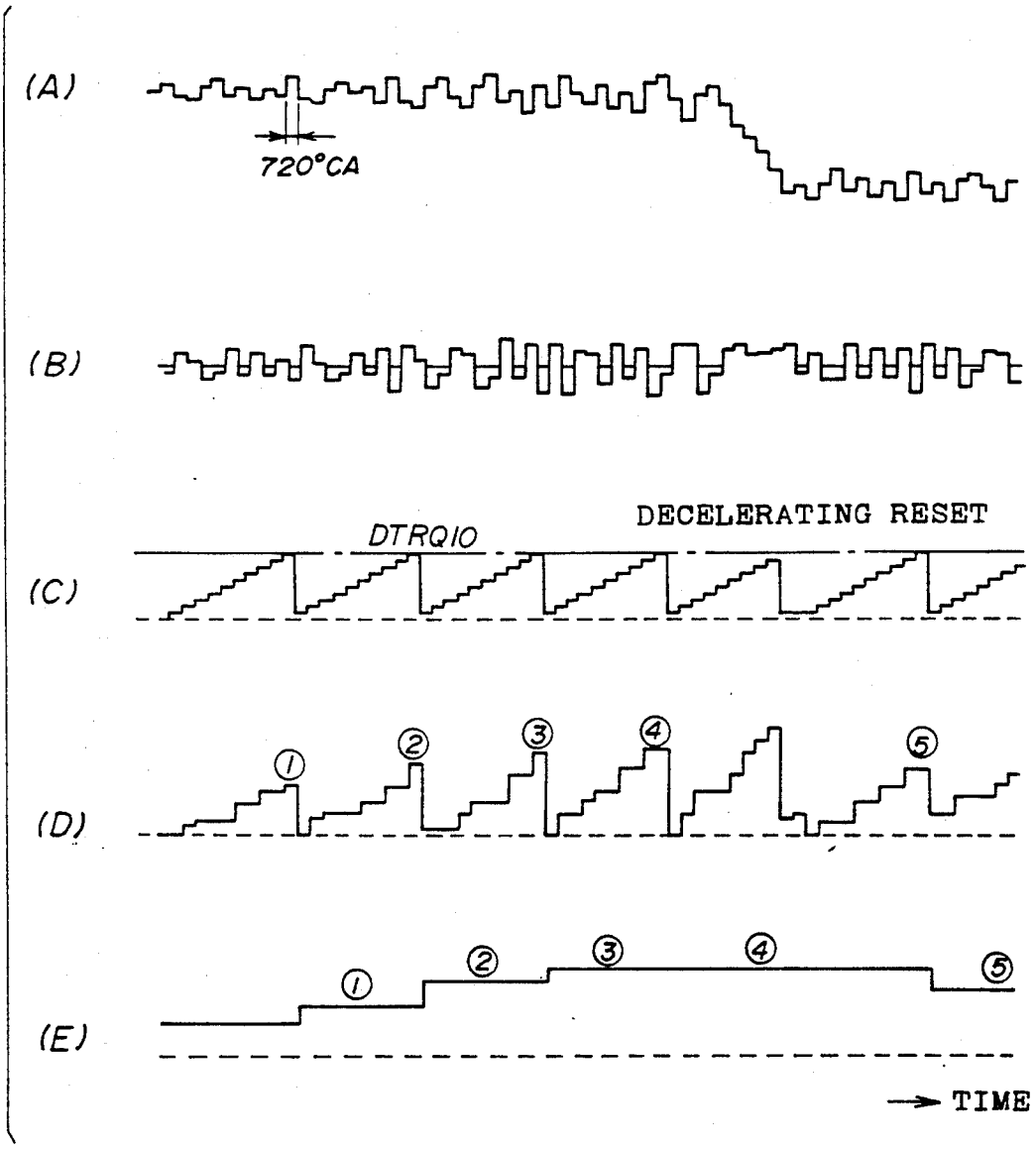
FIG. 6 is a waveform diagram showing a procedure for accumulating intercycle torque variation amounts.

If the brake torque PTRQ changes as shown in (A) of FIG. 6, the intercycle torque variation amount DTRQ changes as shown in (B) of FIG. 6.

At step 103, the CPU 32 determines whether or not a present engine operating area $NOAREA_i$ has changed from the previous engine operating area $NOAREA_{i-1}$. When the present engine operating area $NOAREA_i$ is the same as the previous operating area $NOAREA_{i-1}$, the CPU 32 executes step 104, at which step it is determined whether or not the engine is operating under a condition in which a torque variation determination procedure should be executed. A torque variation decision value (target torque variation amount) KTH is defined for each of the engine operating areas (conditions), as will be described in detail later. The torque variation determination procedure is not carried out when the engine is in a decelerating state, an idle state, an engine starting state, a warm-up state, an EGR ON state, a fuel cutoff state, a state before an average or a weighted average (torque variation amount) is calculated, or a non-learning state. When it is determined, at step 104, that the engine is not in any of the above-mentioned states, the CPU 32 recognizes that the torque variation determination condition is satisfied and executes step 105. It will be noted that the engine is in the decelerating state when the intercycle torque variation amounts DTRQ have positive values continuously, for example, five consecutive times. The torque-variation based control procedure is stopped in the decelerating state because a decrease in torque arising from a decrease in amount of intake air cannot be distinguished from a decrease in torque arising from a degradation in combustion.

At step 105, the CPU 32 calculates the accumulated value of intercycle torque variation amounts, $DTH_i$ as follows:

$$DTH_i = DTH_{i-1} + DTRQ \quad (4)$$

The intercycle torque variation amount accumulating value $DTH_i$ is the sum of the accumulated value $DTH_{i-1}$ of the intercycle torque variation amounts up to the immediately previous time and the intercycle torque variation amount DTRQ calculated at the present time.

At step 106, the CPU 32 determines whether or not the number of cycles CYCLE10 has become equal to a predetermined value (for example, 10). When it is determined, at step 106, that the number of cycles CYCLE10 is smaller than the predetermined value, the CPU 32 increases the number of cycles CYCLE10 by 1 at step 107, and ends the main routine shown in FIG. 4A at step 115.

FIG. 6-(C) shows a change in the number of cycles CYCLE10. After the number of cycles CYCLE10 becomes equal to a predetermined value (indicated by a one-dot chain line in FIG. 6-(C), and equal to, for example, 10), it is reset to zero at step 112. FIG. 6-(D) shows an accumulating procedure on the intercycle torque variation amounts DTRQ. The amount obtained by adding 10 intercycle torque variation amounts DTRQ is the intercycle torque variation amount accumulating value $DTH_i$ shown in FIG. 6-(E).

The intercycle torque variation amount accumulating value obtained by repeatedly executing the above-mentioned main routine a predetermined number of times (for example, 10 times) can be considered as an approximately accurate torque variation amount. After the result of the determination executed at step 106 becomes YES, the CPU 32 executes step 108, at which step a torque variation amount THi is calculated as per the equation below:

$$TH_i = (DTH_i + DTH_{i-1} + DTH_{i-2} + \ldots + DTH_{i-n})/(n+1) \quad (5)$$

It can be seen from equation (5) that the torque variation amount $TH_i$ is an average obtained by dividing, by (n+1), the sum of the accumulated value of the torque variation amounts ((n+1) amounts) between $DTH_i$ obtained this time and $DTH_{i-n}$ obtained n times before.

It is also possible to define the torque variation amount as follows:

$$TH_i = [(m \times TH_{i-1}) + DTH_i]/m \quad (5')$$

It can be seen from equation (5') that the torque variation amount $TH_i$ is a weighted average. The step 108 corresponds to the measurement unit 11 shown in FIG. 1.

After executing step 108, the CPU 32 executes step 109, at which step a target torque variation amount KTH based on the current engine operating condition is calculated based on data (target torque variation amount) read out from a two-dimensional map which is stored in the memory 33 and which stores data identified by, for example, the engine revolution number NE and the amount of intake air QN. The two-dimensional map has storage areas which are specified by intermittent engine revolution numbers and intermittent amounts of intake air. The CPU 32 reads out, from the map, data respectively specified by a predetermined number (four, for example) of engine revolution numbers NE and the predetermined number of the amounts of intake air QN close to the current engine revolution number NE obtained from the detection signal of the crank angle sensor 30 and the current amount of intake air QN obtained from the detection signal of the airflow meter 38. Then, the CPU 32 generates the target torque variation amount KTH suitable for the current engine operating condition by performing an interpolation procedure on the readout data.

At step 110, the CPU 32 executes a torque variation determination procedure by comparing the torque variation amount $TH_i$ with the target torque variation amount KTH obtained at step 109. It is also possible to compare the torque variation amount $TH_i$ with an allowable torque variation amount range which has an upper limit corresponding to the target torque variation amount. If the allowable torque variation range has a width $\alpha$, the lower limit thereof is equal to $KTH-\alpha$. When the allowable torque variation range is used, the CPU 32 determines whether or not the torque variation amount 108 is within the allowable torque variation range.

If it is determined, at step 110, that $KTH > TH_i > KTH-\alpha$, the CPU 32 executes step 112. On the other hand, if it is determined, at step 110, that the torque variation amount $TH_i$ is outside of the allowable torque variation range, the CPU 32 executes step 111 at which step a correction (learning) value $KGCP_i$ is updated. The updating procedure on the correction value $KGCP_i$ is executed as follows:

$$KGCP_i = KGCP_{i-1} + 0.4\% \text{ for } TH_i \geqq KTH \quad (6)$$

$$KGCP_i = KGCP_{i-1} - 0.2\% \text{ for } TH_i \leqq KTH \quad (7)$$

Equation (6) is applied to a case where the torque variation amount $TH_i$ is equal to or greater than the target torque variation amount KTH, and equation (7) is applied to a case where the torque variation amount $TH_i$ is equal to or smaller than the lower limit $KTH-\alpha$ of the allowable torque variation range. The correction value "0.2%" in equation (7) is smaller than the correction value "0.4%" in equation (6). This is due to the following reasons. During the rich-oriented correction procedure, the mixture is excessively lean and the combustion is instable, so that the engine is liable to misfire. In order to prevent the engine from misfiring, it is necessary to rapidly control the torque variation amount TH to be within the allowable torque variation range. During the lean-oriented correction procedure, combustion is stable, and it is thus sufficient to gradually change (decrease) the torque variation amount TH toward the allowable torque variation range.

Figures 8, 9:
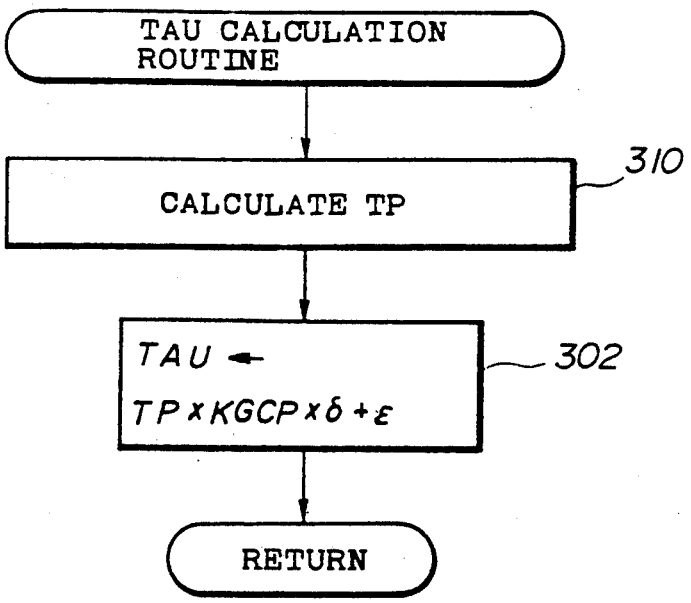
FIG. 8 is a diagram of a two-dimensional map.
FIG. 9 is a flowchart of an injection fuel amount calculation routine.

The correction values $KGCP_i$ are respectively stored in equally divided learning areas K00–K34 of a two-dimensional map shown in FIG. 8, which learning areas are addressed by the engine revolution number NE and a weighted average amount of intake air QNSM. The target torque variation amounts KTH other than those defined in the table can be obtained by the interpolation procedure.

After step 111 is executed, or when it is determined, at step 110, that the torque variation amount is within the allowable torque variation range, the CPU 32 executes step 112 at which step the CPU 32 resets the counter CYCLE10 to zero. At step 115, the CPU 32 ends the routine shown in FIG. 4A.

Step 103 corresponds to the detection unit 14 shown in FIG. 1. When it is determined, at step 103, that the engine operating condition has changed, the CPU 32 resets the intercycle torque variation amount accumulating values $DTH_{i-n} - DTH_{i-1}$ to zero at step 113. At subsequent step 114, the CPU 32 reads out the target torque variation amount KTH related to the changed (new) engine operating condition from the two-dimensional map formed in the memory 33. If necessary, the torque variation amount KTH is obtained by the interpolation procedure. The target torque variation amount thus obtained is used as each of the torque variation amount accumulating values $DTH_{i-n} - DTH_{i-1}$. By using these accumulating values, the torque variation amount $TH_i$ related to the new engine operating condition is obtained at step 108. If equation (5') is used at step 108, the target torque variation amount KTH is used as the previous torque variation amount $TH_{i-1}$. After step 114 is executed, step 112 is executed. The steps 113 and 114 correspond to the updating unit 15.

Figure 7:
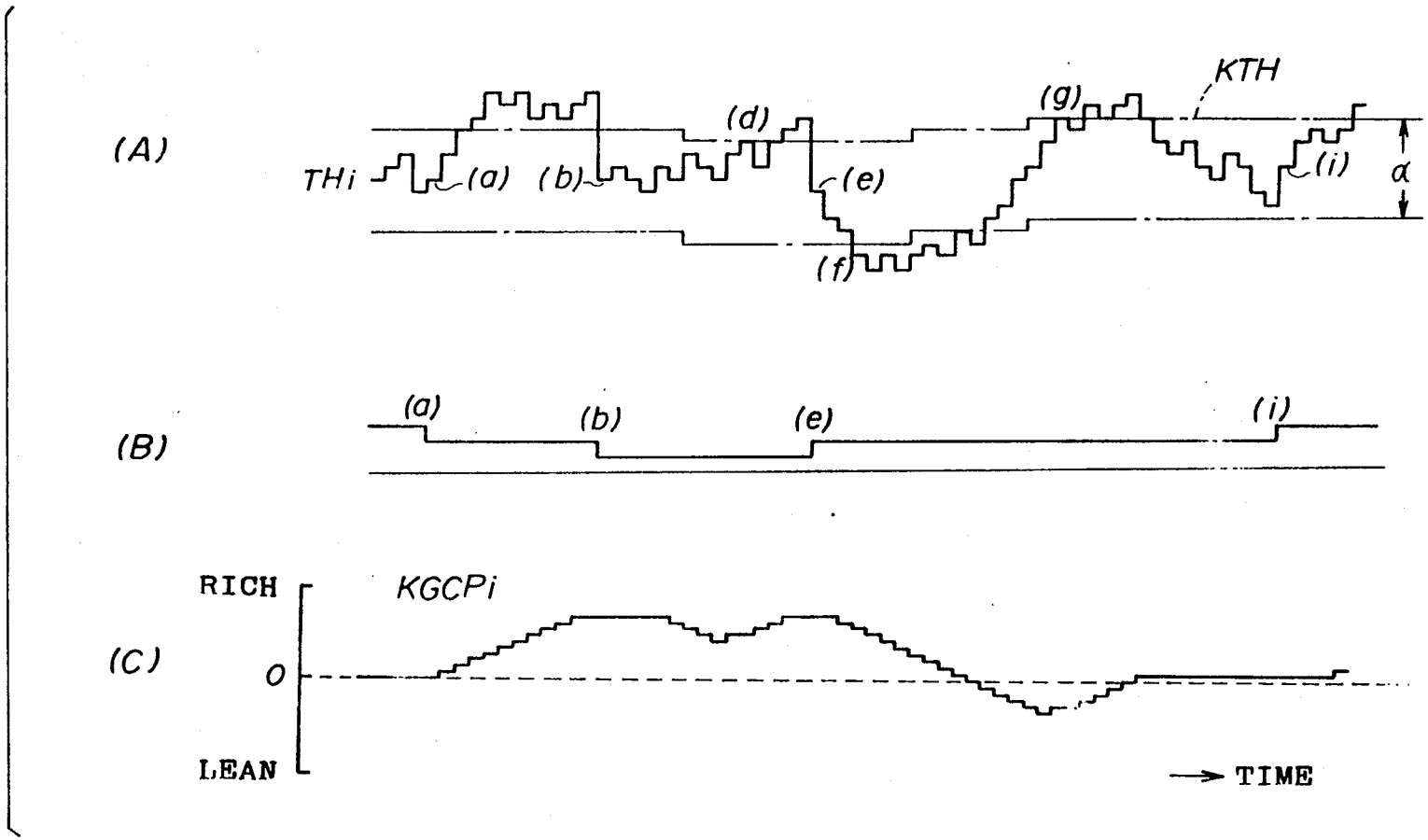
FIG. 7 is a waveform diagram showing a torque variation amount, a counter and a correction (learning) value used in the preferred embodiment of the present invention.

Referring to FIG. 7-(A) which shows a change in the torque variation amount TH, it is now assumed that the engine operating condition changes at times (a), (b), (e) and (i). A change in the engine operating condition is detected at step 103 shown in FIG. 4A. Each time a change in the engine operating condition is detected, the learning area number of the map shown in FIG. 10 changes, and the torque variation decision value KTH obtained from the map by an interpolation procedure changes, as shown in (A) of FIG. 7 (KTH may not change even if the engine operating condition changes because it is calculated by the interpolation procedure).

According to the preferred embodiment of the present invention, the torque variation amount $TH_i$ is calculated by equation (5) or equation (5') in which the target torque variation amount KTH suitable for the changed (new) engine operating state obtained at step 114 is used. With this arrangement, it becomes possible to obtain the suitable target torque variation amount $TH_i$ immediately after the engine operating condition changes.

As shown in (A) of FIG. 7, when the torque variation amount becomes equal to or greater than the target torque variation amount immediately after time (a) or at times (d) or (g), the torque variation amount is gradually increased by equation (6), as shown in (C) of FIG. 7, because the correction value $KGCP_i$ is controlled so that the air-fuel mixture becomes rich.

At time (f) shown in (A) of FIG. 7, the torque variation amount $TH_i$ becomes equal to or smaller than the lower limit $KTH-\alpha$. At this time, the correction value $KGCP_i$ is decreased by equation (7), as shown in FIG. 7, so that the air-fuel mixture becomes lean. It will be noted that in (C) of FIG. 7, the magnitude of the correction value in equation (6) has been made the same as that in equation (7) for the sake of simplicity.

A description will now be given of an air-fuel ratio control procedure based on the correction value $KGCP_i$ with reference to FIG. 9. FIG. 9 shows a fuel injection time (TAU) calculation routine, which is activated every predetermined crank angle (for example, 360°). At step 301, the CPU 32 reads data about the amount of intake air QNSM and the engine revolution number NE from the map stored in the memory 33 and calculates a basic fuel injection time TP therefrom. At step 302, the CPU 32 calculates the fuel injection time TAU as follows:

$$TAU \leftarrow TP \times KGCP \times \delta + \epsilon \quad (8)$$

where $\delta$ and $\epsilon$ are correction values based on other engine operating parameters, such as the throttle opening angle and a warm-up fuel increase coefficient. The aforementioned fuel injection values $25_1$–$25_4$ inject fuel during the fuel injection time TAU. When the calculation based on equation (6) is executed at step 111, the correction value $KGCP_i$ used in equation (8) is increased and the fuel injection period TAU is lengthened. Hence, the air-fuel ratio is controlled so that the mixture becomes rich. On the other hand, when the calculation based on equation (7) is executed at step 111, the correction value $KGCP_i$ is decreased and the fuel injection period TAU is shortened. Hence, the air-fuel ratio is controlled so that the mixture becomes lean. The steps 110 and 111 correspond to the control unit 12 shown in FIG. 1.

The present invention is not limited to the specifically disclosed embodiment. It is possible to set the torque variation amount $TH_i$ to be the central value of the allowable torque variation range related to the changed (new) engine operating condition. It is also possible to control the amount of recirculated exhaust gas instead of the air-fuel ratio. When the correction value $KGCP_i$ is increased, a decreased amount of recirculated exhaust gas is fed back to the air intake system, so that the mixture becomes rich. When the correction value $KGCP_i$ is decreased, an increased amount of recirculated exhaust gas is fed back, so that the mixture becomes lean. It is also possible to use only the target torque variation amount instead of the allowable torque variation range.

The present invention is not limited to the specifically disclosed embodiments, and variations and modifications may be made without departing from the scope of the present invention.

What is claimed is:

1. An apparatus for controlling a torque generated by an internal combustion engine, said apparatus comprising:

measurement means for periodically measuring a torque variation amount of said internal combustion engine;

detection means for detecting an engine operating condition and a predetermined change therein;

storage means for storing target torque variation amounts respectively related to predetermined engine operating conditions;

control means, operatively coupled to said measurement means, said detection means and storage means, for controlling a predetermined engine control parameter of said internal combustion engine so that the torque variation amount is approximately equal to one of the target torque variation amounts related to one of the predetermined engine operating conditions which corresponds to the engine operating condition detected by said detection means; and updating means, operatively coupled to said storage means, said detection means and said control means, for generating, when said detection means detects the predetermined change in the engine operating condition, an updated torque variation amount from at least one of the target torque variation amounts which is read out from said storage means on the basis of a new engine operating condition obtained after the predetermined change in the engine operating condition and for outputting the updated torque variation amount to said control means.

2. An apparatus as claimed in claim 1, wherein:

said measurement means comprises means for generating a first value obtained by accumulating intercycle torque variation amounts during a predetermined period, each of the intercycle torque variation amounts corresponding to a torque difference between consecutive cycles of the internal combustion engine and for generating a first average of $(n+1)$ first values, said first average corresponding to the torque variation amount;

said updating means comprises means for generating a second average of the first value obtained at the present time and n second values, each of said n second values corresponding to said at least one of the target torque variation amounts which is read out from said storage means, said second average corresponding to said updated torque variation amount used immediately after the predetermined change in the engine operating condition.

3. An apparatus as claimed in claim 1, wherein:

said measurement means comprises means for generating a first value obtained by accumulating intercycle torque variation amounts during a predetermined period, each of the intercycle torque variation amounts corresponding to a torque difference between consecutive cycles of the internal combustion engine and for generating a first average of $(n+1)$ first values, said first average corresponding to the torque variation amount;

said updating means comprises means for generating a second weighted average of an immediately previous torque variation amount and the first value obtained at the present time, said second weighted average corresponding to said updated torque variation amount used immediately after the predetermined change in the engine operating condition.

4. An apparatus as claimed in claim 1, wherein: said updating means comprises means for reading, from said storage means, a predetermined number of target torque variation amounts related to the new engine operating condition and for generating the updated torque variation from the predetermined number of target torque variation amounts.

5. An apparatus as claimed in claim 1, wherein said detection means comprises means for detecting the engine operating condition and the predetermined change therein from the amount of intake air and an engine revolution number.

6. An apparatus as claimed in claim 1, wherein:

said predetermined engine control parameter is an air-fuel ratio; and said control means comprises means for controlling the air-fuel ratio so that the torque variation amount is equal to said one of the target torque variation amounts.

7. An apparatus as claimed in claim 1, wherein:

said predetermined engine control parameter is an amount of recirculated exhaust gas which is fed back to an air intake system of the internal combustion engine from an exhaust system thereof; and said control means comprises means for controlling the amount of recirculated exhaust gas so that the torque variation amount is equal to said one of the target torque variation amounts.

8. An apparatus as claimed in claim 1, wherein said torque variation amount shows only a decrease in the torque generated by the internal combustion engine.

9. An apparatus for controlling a torque generated by an internal combustion engine, said apparatus comprising:

measurement means for periodically measuring a torque variation amount of said internal combustion engine;

detection means for detecting an engine operating condition and a predetermined change therein;

storage means for storing target torque variation amounts respectively related to predetermined engine operating conditions;

control means, coupled to said measurement means and storage means, for controlling a predetermined engine control parameter of said internal combustion engine so that the torque variation amount is within an allowable torque variation amount range including one of the target torque variation amounts related to one of the predetermined engine operating conditions which corresponds to the engine operating condition detected by said detection means; and updating means, coupled to said storage means and said control means, for generating, when said detection means detects the predetermined change in the engine operating condition, an updated torque variation amount from at least one of the target torque variation amounts which is read out from said storage means on the basis of a new engine operating condition obtained after the predetermined change in the engine operating condition and for outputting the updated torque variation amount to said control means.

10. An apparatus as claimed in claim 9, wherein:

said measurement means comprises means for generating a first value obtained by accumulating intercycle torque variation amounts during a predetermined period, each of the intercycle torque variation amounts corresponding to a torque difference between consecutive cycles of the internal combustion engine and for generating a first average of $(n+1)$ first values, said first average corresponding to the torque variation amount;

said updating means comprises means for generating a second average of the first value obtained at the present time and n second values, each of said n second values corresponding to said at least one of the target torque variation amounts which is read out from said storage means, said second average corresponding to said updated torque variation amount used immediately after the predetermined change in the engine operating condition.

11. An apparatus as claimed in claim 9, wherein:

said measurement means comprises means for generating a first value obtained by accumulating intercycle torque variation amounts during a predetermined period, each of the intercycle torque variation amounts corresponding to a torque difference between consecutive cycles of the internal combustion engine and for generating a first average of $(n+1)$ first values, said first average corresponding to the torque variation amount;

said updating means comprises means for generating a second weighted average of an immediately previous torque variation amount and the first value obtained at the present time, said second weighted average corresponding to said updated torque variation amount used immediately after the predetermined change in the engine operating condition.

12. An apparatus as claimed in claim 9, wherein: said updating means comprises means for reading, from said storage means, a predetermined number of target torque variation amounts related to the new engine operating condition and for generating the updated torque variation from the predetermined number of target torque variation amounts.

13. An apparatus as claimed in claim 9, wherein said detection means comprises means for detecting the engine operating condition and the predetermined change therein from the amount of intake air and an engine revolution number.

14. An apparatus as claimed in claim 9, wherein:

said predetermined engine control parameter is an air-fuel ratio; and said control means comprises means for controlling the air-fuel ratio so that the torque variation amount is equal to said one of the target torque variation amounts.

15. An apparatus as claimed in claim 9, wherein:

said predetermined engine control parameter is an amount of recirculated exhaust gas which is fed back to an air intake system of the internal combustion engine from an exhaust system thereof; and said control means comprises means for controlling the amount of recirculated exhaust gas so that the torque variation amount is equal to said one of the target torque variation amounts.

16. An apparatus as claimed in claim 9, wherein said torque variation amount shows only a decrease in the torque generated by the internal combustion engine.

17. An apparatus as claimed in claim 9, wherein the allowable torque variation amount range has an upper limit which corresponds to said one of the target torque variation amounts related to one of the predetermined engine operating conditions which corresponds to the engine operating condition detected by said detection means.

18. An apparatus as claimed in claim 9, wherein the allowable torque variation amount range has a central value which corresponds to said one of the target torque variation amounts related to one of the predetermined engine operating conditions which corresponds to the engine operating condition detected by said detection means.

* * * * *

UNITED STATES PATENT AND TRADEMARK OFFICE

CERTIFICATE OF CORRECTION

PATENT NO. : 5,156,128

DATED : October 20, 1992

INVENTOR(S) : Norihisa NAKAGAWA

It is certified that error appears in the above-identified patent and that said Letters Patent is hereby corrected as shown below:

ABSTRACT, line 17, change "update" to --updated--.

Column 4, line 2, change "value" to --valve--.

Column 4, line 44, change "positions. A timer" to --positions, a timer--.

Column 4, line 58, change "Cpn=K1x(VCpn-VCpO)" to --CPn=K1x(VCPn-VCPO)--.

Column 4, line 65, change "(0.5 CP1.." to --(0.5CP1..--.

Column 5, line 7, put "(DTRQ = 0)" directly under "$PTRQ_i$" in line 5.

Column 10, line 23, change "wherein: said" to --wherein said--.

UNITED STATES PATENT AND TRADEMARK OFFICE

CERTIFICATE OF CORRECTION

PATENT NO. : 5,156,128

DATED : October 20, 1992

INVENTOR(S) : Norihisa NAKAGAWA

It is certified that error appears in the above-identified patent and that said Letters Patent is hereby corrected as shown below:

Column 12, line 4, change "wherein: said" to --wherein said--.

Signed and Sealed this

Ninth Day of November, 1993

*Attest:*

*Attesting Officer*

BRUCE LEHMAN

*Commissioner of Patents and Trademarks*